United States Patent [19]

Brzezinski et al.

[11] 3,958,662

[45] May 25, 1976

[54] TENSIONED DIAPHRAGM MOUNTING FOR AN ELECTROACOUSTIC TRANSDUCER

[75] Inventors: Alex Michael Brzezinski; Joe Edward Warren, both of Indianapolis, Ind.

[73] Assignee: Bell Telephone Laboratories, Incorporated, Murray Hill, N.J.

[22] Filed: Feb. 18, 1975

[21] Appl. No.: 550,534

[52] U.S. Cl. ..... 181/171; 179/111 R

[51] Int. Cl.[2] ..... H04R 7/24; H04R 19/00

[58] Field of Search ..... 179/111 R, 111 E, 115 R; 181/131, 137, 171, 172

[56] References Cited

UNITED STATES PATENTS

| | | | |
|---|---|---|---|
| 2,086,107 | 7/1937 | Wilson | 179/111 R |
| 3,663,768 | 5/1972 | Madsen et al. | 179/111 E |
| 3,814,864 | 6/1974 | Victoreen | 179/111 R |
| 3,816,671 | 6/1974 | Fraim et al. | 179/111 E |

*Primary Examiner*—Kathleen H. Claffy
*Assistant Examiner*—George G. Stellar
*Attorney, Agent, or Firm*—Harry L. Newman

[57] ABSTRACT

A transducer in accordance with the present invention includes a cylindrical housing that is open at one end and has an inwardly extending lip at the other end, a disc shaped membrane diaphragm being supported on the lip. An annular insulator rests on the periphery of the diaphragm, and a compressible annular spring member rests, in turn, on the insulator. In addition, a back plate having a central portion for engaging the diaphragm and a perimeter portion for engaging the spring member is positioned with the central portion in juxtaposition with the diaphragm and the perimeter portion resting on the spring member. The central portion extends from the perimeter portion, and the height of the central portion is less than the height of the insulator plus the height of the spring member prior to its being compressed and greater than the height of the insulator plus the final compressed height of the spring member. Means, such as a lock ring threaded into the open end of the housing, are provided to move the back plate toward the diaphragm and thereby compress the spring member.

14 Claims, 3 Drawing Figures

TENSIONED DIAPHRAGM MOUNTING FOR AN ELECTROACOUSTIC TRANSDUCER

FIELD OF THE INVENTION

This invention relates to electroacoustic transducers and within that field to electrostatic transducers such as electret microphones.

BACKGROUND OF THE INVENTION

One of the major problems in the assembly of an electret transducer is obtaining the correct tension in the transducer membrane diaphragm. The diaphragm tension greatly influences the transducer's frequency of resonance and acoustic sensitivity. A higher tension produces a higher resonant frequency, while a lower tension produces a greater sensitivity. Thus, the diaphragm tension is critical.

Several ways are taught in the prior art for obtaining the desired tension. A first approach, illustrated in Wilson U.S. Pat. No. 2,086,107 dated July 6, 1937, involves the use of a threaded lock ring to peripherally clamp the diaphragm within the transducer housing in a flat condition with essentially zero tension. A back plate that engages the central portion of the diaphragm is thereafter advanced in a controlled manner, such as by another threaded member, to apply a selected tension to the diaphragm.

Another approach, illustrated in Madsen et al U.S. Pat. No. 3,663,768 dated May 16, 1972 and Fraim et al U.S. Pat. No. 3,816,671 dated June 11, 1974, comprises applying the desired tension to the diaphragm by some means external to the transducer. The diaphragm is then joined to the back plate while under tension. This is accomplished by either mechanically clamping the diaphragm to the back plate as disclosed in Madsen or bonding the diaphragm to the back plate as disclosed in Fraim.

A still further approach, illustrated in Victoreen U.S. Pat. No. 3,814,864 dated June 4, 1974, consists of first affixing the diaphragm to a peripheral support member while under tension. This combination and the back plate are then assembled, and the back plate is further adjusted relative to the diaphragm support to achieve the final tension.

All of the foregoing arrangements require a fairly large number of assembly steps and/or some fairly elaborate fixturing in order to place the diaphragm under the desired tension. This necessarily increases the cost of manufacturing the transducer unit.

SUMMARY OF THE INVENTION

The transducer structure of the present invention provides the desired diaphragm tension in essentially a single assembly step. A transducer in accordance with the present invention includes a cylindrical housing that is open at one end and has an inwardly extending lip at the other end, a disk shaped membrane diaphragm being supported on the lip. An annular insulator rests on the periphery of the diaphragm, and a compressible annular spring member rests, in turn, on the insulator. In addition, a back plate having a central portion for engaging the diaphragm and a perimeter portion for engaging the spring member is positioned with the central portion in juxtaposition with the diaphragm and the perimeter portion resting on the spring member. Finally, means, such as a lock ring threaded into the open end of the housing, are provided to move the back plate toward the diaphragm and thereby compress the spring member.

The diaphragm engaging central portion of the back plate extends from the spring member engaging perimeter portion of the back plate, and the height of the central portion is less than the height of the insulator plus the height of the spring member prior to its being compressed. Thus, prior to the compression of the spring member by the back plate, the central portion of the back plate is spaced from the diaphragm. Furthermore, the space therebetween is such that as the spring member is compressed by the initial movement of the back plate toward the diaphragm, the central portion does not engage the diaphragm. Instead, the compressed spring member clamps the periphery of the diaphragm between the insulator and the lip of the housing.

The height of the central portion of the back plate is, however, greater than the height of the insulator plus the final compressed height of the spring member. Consequently, continued movement of the back plate toward the diaphragm brings the central portion into engagement with the diaphragm, and since the periphery of the diaphragm is clamped, this engagement tensions the diaphragm. The height of the central portion of the back plate and the insulator and the final compressed height of the spring member are selected so that when the latter is reached, the desired tension has been automatically applied to the diaphragm.

DETAILED DESCRIPTION

Figure 1:
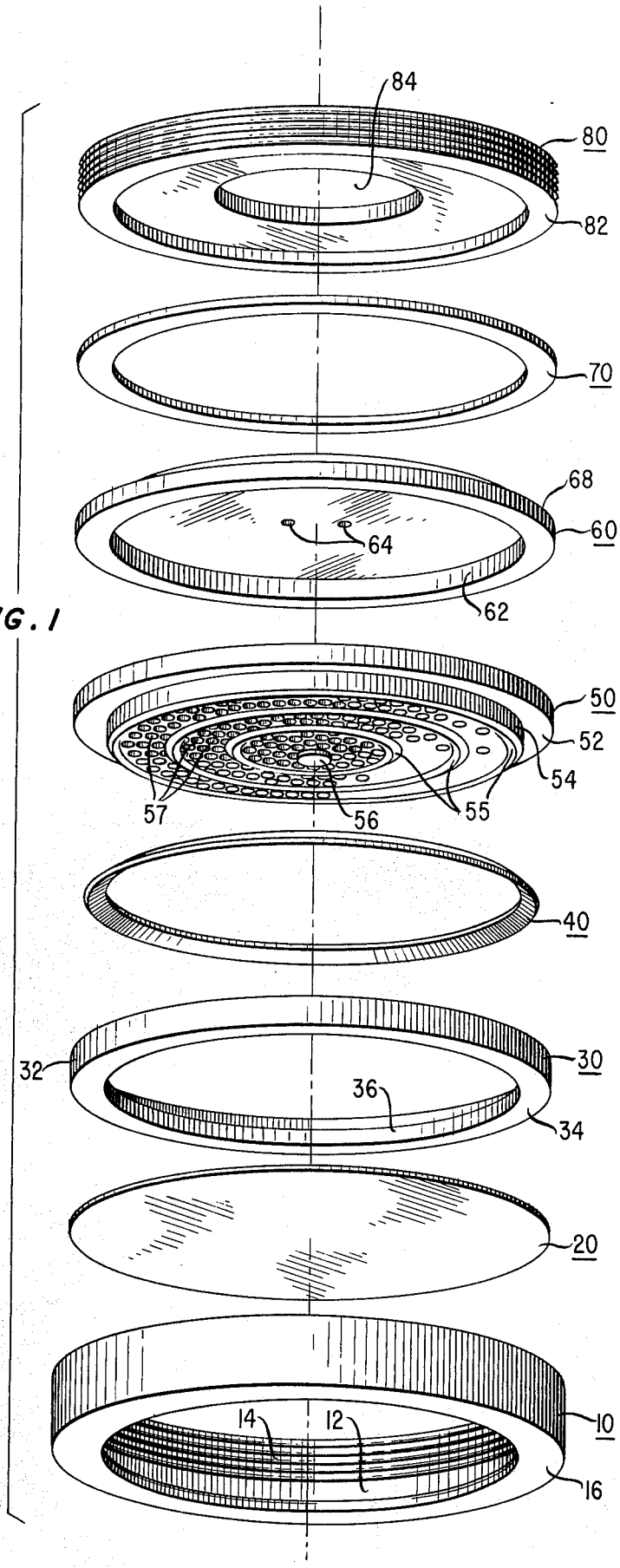
FIG. 1 is an exploded perspective view of an electroacoustic transducer in accordance with the present invention.
Figure 2:
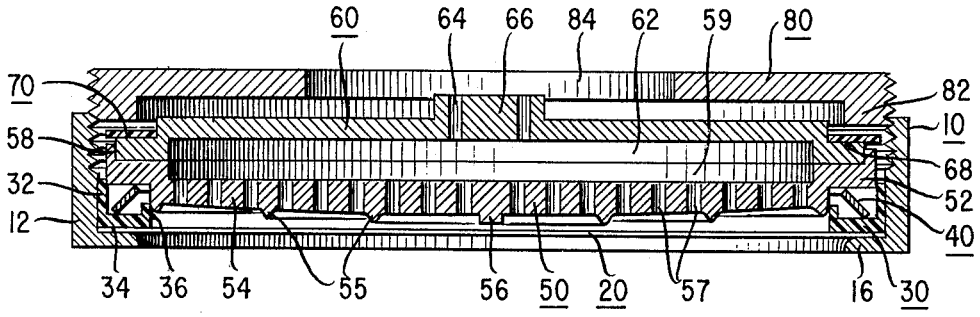
FIG. 2 is a sectional view showing the components of the transducer prior to the assembly step by which the desired tension is applied to the diaphragm of the transducer.

Referring to FIGS. 1 and 2 of the drawing, an electret transducer in accordance with the present invention includes a housing 10 comprising a cylindrical wall 12 having an internally threaded surface 14 adjacent to one end thereof. The other end of the wall 12 has an inwardly extending lip 16 that serves as a diaphragm support, and the upper inside edge of the lip is rounded to provide a smooth diaphragm tensioning surface. The housing 10 serves as one terminal of the transducer and therefore it is advantageously covered by a good electrical contact surface, such as a film of gold applied over a copper flash.

A disc shaped electret diaphragm 20 having a diameter that is smaller than the internal diameter of the wall 12 and greater than the internal diameter of the lip 16 is positioned on the upper surface of the lip. The diaphragm 20 is formed from a thin sheet of dielectric material, such as polytetrafluoroethylene sold under the trademark Teflon. The side of the dielectric membrane in engagement with the lip 16 of the housing 10, is metallized with, for example, a thin layer of aluminum, and the diaphragm is charged such as by the method disclosed in the article entitled "Thermal Currents from Corona Charged Mylar" by Robert A. Creswell and Martin M. Perlman apearing in the Journal of Applied Physics, Vol. 41, No. 6, May 1970.

A cylindrical dielectric insulator 30 nests within the housing 10 and rests on the diaphragm 20, the insulator comprising a wall 32 having an outside diameter slightly less than the inside diameter of the wall 12 of the housing. The end of the wall 32 in engagement with the diaphragm 20 includes a flush inwardly extending lip 34 having an inside diameter that is slightly less than the inside diameter of the lip 16 of the housing 10. Thus the lip 34 overlaps the peripheral portion of the diaphragm 20 resting on the lip 16 of the housing 10. In addition the inside edge of the lip 34 includes an upstanding flange that serves as a stop 36. The insulator 30 is advantageously molded from a plastic material such as that sold under the trademark Delrin.

The wall 32, lip 34, and stop 36 of the insulator 30 combine to provide a circular groove in which an annular compressible spring member 40 is positioned. The uncompressed height of the spring member 40 is greater than the height of the stop 36, and the spring member is compressible to a height that is the same as or less than that of the stop. While the spring member 40 shown comprises a bellville spring washer formed from a resilient metal such as spring steel, any compressible member formed from any resilient material may be employed.

A circular back plate 50 nests within the insulator 30 and includes a perimeter portion 52 that rests on the spring member 40, the outside diameter of the back plate being slightly less than the inside diameter of the wall 32 of the insulator. A circular central portion 54 for engaging the diaphragm 20 extends from the perimeter portion 52 into juxtaposition with the diaphragm. The outside diameter of the central portion 54 is slightly less than the inside diameter of the lip 34 of the insulator 30, and thus the central portion is of a size to move into the opening defined by the inside diameter of the lip 16 of the housing 10. In addition, the face of the central portion 54 has a plurality of spaced concentric circular ridges 55 and a center post 56 extending therefrom, the outer most ridge being situated at the outer edge of the central portion.

The ridges 55 and post 56 are the elements of the central portion 54 that engage the diaphragm 20, and the volume contained between the diaphragm and the face of the central portion 54 when the diaphragm is tensioned across the crests of the ridges and post define the air gap between the diaphragm and the back plate 50. Thus the air gap is controlled by the height of the ridges 55 and post 56 and by intimate contact of the diaphragm 20 therewith. To assure such intimate contact, the heights of the ridges 55 and post 56 are graduated, in the order of microinches, toward the center of the central portion 54 so as to provide a very slightly domed locus. Furthermore, to relieve the back pressure between the diaphragm 20 and the back plate 50, a multiplicity of holes 57 are provided that extend from the face to the back of the back plate.

The height of the central portion 54, this being the distance between the plane defined by the face of the perimeter portion and the approximate plane defined by the crests of the ridges 55 and post 56, bears a particular relationship to the spring member 40 and the lip 34 of the insulator 30. In general, the height of the central portion 54 is less than the height of the lip 34 plus the height of the spring member 40 prior to its being compressed, this combined height being referred to as the first combined height. In addition, the height of the central portion 54 is greater than the height of the lip 34 plus the height of the spring member 40 after it has been compressed, this combined height being referred to as the second combined height.

More particularly, the difference between the height of the central portion 54 and the first combined height is such as to permit the spring member 40 to be compressed far enough to exert sufficient force against the lip 34 of the insulator 30 to clamp the periphery of the diaphragm 20 between the insulator and the lip 16 of the housing 10 before the central portion moves into engagement with the diaphragm. Furthermore, the difference between the height of the central portion 54 and the second combined height is such as to apply the desired tension to the diaphragm 20.

As seen in FIG. 2, the back of the back plate 50 includes a rim 58 extending upwardly from the outer edge of the lip 52, and a circular contact plate 60 having an outside diameter slightly less than the inside diameter of the rim nests therewithin on the back plate. The face of the contact plate 60 includes a circular recess 62 that is the same size as a circular recess 59 in the back of the back plate 50, and the two recesses cooperate to form the back chamber of the transducer. Holes 64 in the contact plate 60 serve to pressure equalization in the back chamber with changes in ambient air pressure, the volume of which helps establish the transducer's resonant frequency. The back plate 50 and contact plate 60 also cooperate to provide the second terminal of the transducer, the back of the contact plate having a center boss 66 for this purpose, and therefore, like the housing 10, both the back plate and contact plate advantageously have a good electrical contact surface applied thereto.

The periphery of the back of the contact plate 60 is relieved to provide a circular ledge 68 and an annular dielectric spacer 70 is accommodated thereon, the outside diameter of the spacer being less than the inside diameter of the wall 12 of the housing 10. The spacer 70 serves to electrically insulate the contact plate 60 from an externally threaded lock ring 80. The lock ring 80 is adapted to mesh with the internal threads 14 of the housing 10, and the perimeter of the face of the lock ring has a circular rim 82 for engaging the spacer 70. In addition the lock ring 80 has a center opening 84 for providing access to the contact plate 60.

Figure 3:
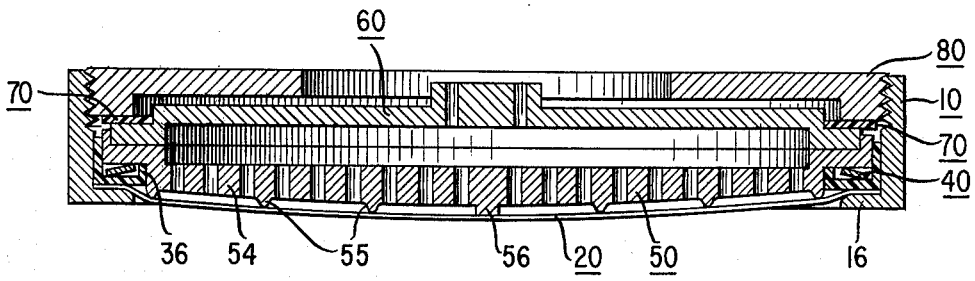
FIG. 3 is a sectional view similar to FIG. 2 showing the transducer fully assembled.

Referring now to FIGS. 2 and 3, after the lock ring 80 is screwed into the housing 10 far enough for the rim 82 thereof to engage the spacer 70, further rotation of the lock ring results in moving the spacer 70, contact plate 60, and back plate 50 toward the diaphragm 20. The spring member 40 is thereby compressed, and prior to the ridges 55 and post 56 on the central portion 54 of the back plate 50 engaging the diaphragm 20, the spring member applies sufficient force against the lip 34 of the insulator 30 to clamp the periphery of the diaphragm between the lip 34 and lip 16 of the housing 10.

As the rotation of the lock ring 80 continues, the ridges 55 and post 56 on the central portion 54 of the back plate 50 engage the diaphragm 20 and commence to stress it. Then when the rotation of the lock ring moves the perimeter portion 52 of the back plate 50 into engagement with the stop 36 of the insulator 30, the diaphragm 20 is stressed to provide the desired tension.

Although the described embodiment includes a threaded lock ring 80 for moving the back plate 50 into engagement with the diaphragm 20, the same result can be achieved by other means, such as swaging over the upper end of the housing 10. In addition, while the described embodiment includes a stop 36 for locating the final position of the back plate 50, other means, such as the collapsed height of the spring member 40, may be used. Furthermore while the described embodiment comprises a circular transducer, the same arrangement can be used equally well for any other shapes, such as a rectangular transducer. Finally, while the described components consist of unitary members, each member may be made up of several discrete elements or, on the other hand, individual ones of the described components, such as the insulator 30 and spring member 40, may be combined into a single component. These and other changes may be made by persons skilled in the art without departing from the spirit and scope of the invention as set forth in the appended claims.

What is claimed is:

1. An electroacoustic transducer comprising:

a diaphragm;

means for supporting the periphery of the diaphragm;

means including compressible means for clamping the periphery of the diaphragm against the support means, the clamping means having a first height prior to compression and a second height after compression is completed; and tensioning means having a perimeter portion for compressing the clamping means from its first to its second height and a central portion for engaging the diaphragm, the central portion having a height that is less than the first height of the clamping means and greater than the second height of the clamping means, the difference between the height of the central portion of the tensioning means and the first height of the clamping means being such that as the tensioning means compresses the clamping means from its first to its second height, the clamping means exerts sufficient force to clamp the periphery of the diaphragm against the support means before the central portion of the tensioning means engages the diaphragm, the diaphragm being tensioned by the engagement of the central portion.

2. A transducer as in claim 1 wherein the difference between the height of the central portion of the tensioning means and the second height of the clamping means is such that when the tensioning means has compressed the clamping means to its second height, the central portion of the tensioning means has engaged the diaphragm and has stressed it to a selected tension.

3. A transducer as in claim 2 wherein the clamping means includes dielectric insulator means overlying the support means and resting on the periphery of the diaphragm.

4. A transducer as in claim 2 wherein the clamping means includes compressible spring means for pressing the periphery of the diaphragm against the support means when the spring means is compressed.

5. A transducer as in claim 2 wherein the means for supporting the periphery of the diaphragm comprises a housing having an opening therein and a lip extending around the perimeter of the opening for accommodating the periphery of the diaphragm.

6. A transducer as in claim 5 wherein the clamping means includes a dielectric insulator for electrically isolating the tensioning means from the housing, the insulator including a lip overlying the lip of the housing and resting on the periphery of the diaphragm, the lip of the insulator defining an opening approximately the same size as the opening in the housing.

7. A transducer as in claim 6 wherein the housing includes a wall extending generally orthogonal to the lip of the housing and the insulator includes a wall extending generally orthogonal to the lip of the insulator that nests within the wall of the housing.

8. A transducer as in claim 6 wherein the clamping means further includes a compressible spring member that rests on the lip of the insulator, the height of said lip plus the height of the spring member prior to its being compressed being the first height of the clamping means and the height of said lip plus the height of the spring member after it has been compressed being the second height of the clamping means.

9. A transducer as in claim 8 wherein the insulator includes a stop engaged by the tensioning means for selecting the second height of the clamping means.

10. A transducer as in claim 8 wherein the tensioning means includes a back plate having a perimeter portion for engaging the spring member and a central portion for engaging the diaphragm, the perimeter portion resting on the spring member and the central portion extending from the perimeter portion into juxtaposition with the diaphragm, the central portion extending from the perimeter portion a particular height and being of a size to be accommodated by the openings in the insulator and the housing.

11. A transducer as in claim 10 wherein the difference between the height of the central portion of the back plate and the first height of the clamping means is such that as the back plate compresses the clamping means from its first to its second height, the spring member exerts sufficient force against the lip of the insulator to clamp the periphery of the diaphragm between the insulator and the lip of the housing before the central portion engages the diaphragm.

12. A transducer as in claim 11 wherein the difference between the height of the central portion of the back plate and the second height of the clamping means is such that when the back plate has compressed the clamping means to its second height, the central portion of the back plate has engaged the diaphragm and stressed it to apply a selected tension thereto.

13. A transducer as in claim 12 wherein the face of the back plate includes ridges extending therefrom that engage the diaphragm the distance between the crests of the ridges and the face of the back plate defining the air gap between the diaphragm and the back plate.

14. A transducer as in claim 13 wherein the back plate includes a multiplicity of holes that extend from the face to the back of the back plate, the transducer further including a contact plate resting on the back of the back plate, the adjacent surfaces of the back plate and the contact plate having recesses therein that provide the back chamber of the transducer.

* * * * *